US007445127B2

(12) United States Patent
Pittman

(10) Patent No.: US 7,445,127 B2
(45) Date of Patent: Nov. 4, 2008

(54) UNIVERSAL SHOE RACK

(76) Inventor: Craig A. Pittman, 12819 SE. 38th St., PMB #72, Bellevue, WA (US) 98006

( * ) Notice: Subject to any disclaimer, the term of this patent is extended or adjusted under 35 U.S.C. 154(b) by 397 days.

(21) Appl. No.: 11/244,689

(22) Filed: Oct. 6, 2005

(65) Prior Publication Data

US 2007/0080121 A1 Apr. 12, 2007

(51) Int. Cl.
*A47F 7/08* (2006.01)

(52) U.S. Cl. ..... 211/35

(58) Field of Classification Search ..... 211/35, 211/34, 37, 13.1, 85.3, 189, 190
See application file for complete search history.

(56) References Cited

U.S. PATENT DOCUMENTS

| | | | | | |
|---|---|---|---|---|---|
| 1,949,017 | A | * | 2/1934 | Knupp | 211/35 |
| 2,213,838 | A | * | 9/1940 | Gyldenvand | 211/35 |
| 2,587,971 | A | * | 3/1952 | Crawford | 12/120.5 |
| 3,123,850 | A | * | 3/1964 | Piken | 15/257.01 |
| 3,249,231 | A | * | 5/1966 | Matlock | 211/35 |
| 4,192,424 | A | * | 3/1980 | Allsop | 211/37 |
| 4,693,380 | A | * | 9/1987 | Muth | 211/35 |
| 4,697,713 | A | | 10/1987 | Pryor | |
| 4,984,327 | A | * | 1/1991 | Braverman | 15/267 |
| 5,050,746 | A | | 9/1991 | Frankel | |
| 5,170,892 | A | | 12/1992 | Fromkin | |
| 5,855,279 | A | | 1/1999 | Klein | |
| 5,894,940 | A | | 4/1999 | Gusdorf | |
| 5,984,114 | A | | 11/1999 | Frankel | |
| 6,533,127 | B1 | | 3/2003 | Klein | |
| 6,637,603 | B2 | | 10/2003 | Klein | |
| 6,719,157 | B2 | | 4/2004 | Stoddart | |
| 6,793,080 | B2 | | 9/2004 | Klein | |
| 6,877,615 | B2 | | 4/2005 | Klein | |
| 6,926,157 | B2 | | 8/2005 | Klein | |

* cited by examiner

*Primary Examiner*—Sarah Purol

(57) ABSTRACT

A shoe rack for hanging, storing, or displaying shoes comprising: a central support structure; and a plurality of brackets that are mounted to the central support structure, said brackets each including a mounting hook and a heel support, said mounting hook which protrudes from the front surface of the central support structure and terminates with a hooked portion which is directed in a downward position and angled towards the heel support, said mounting hook positioned such that the inside back portion of a shoe comes into contact with the mounting hook and the back of the shoe comes into contact with the heel support that is located below the mounting hook, such that the shoe would be held in a substantially horizontal orientation, with the front of the shoe pointed in a direction opposite to that of the central support structure.

8 Claims, 7 Drawing Sheets

FIG. 4
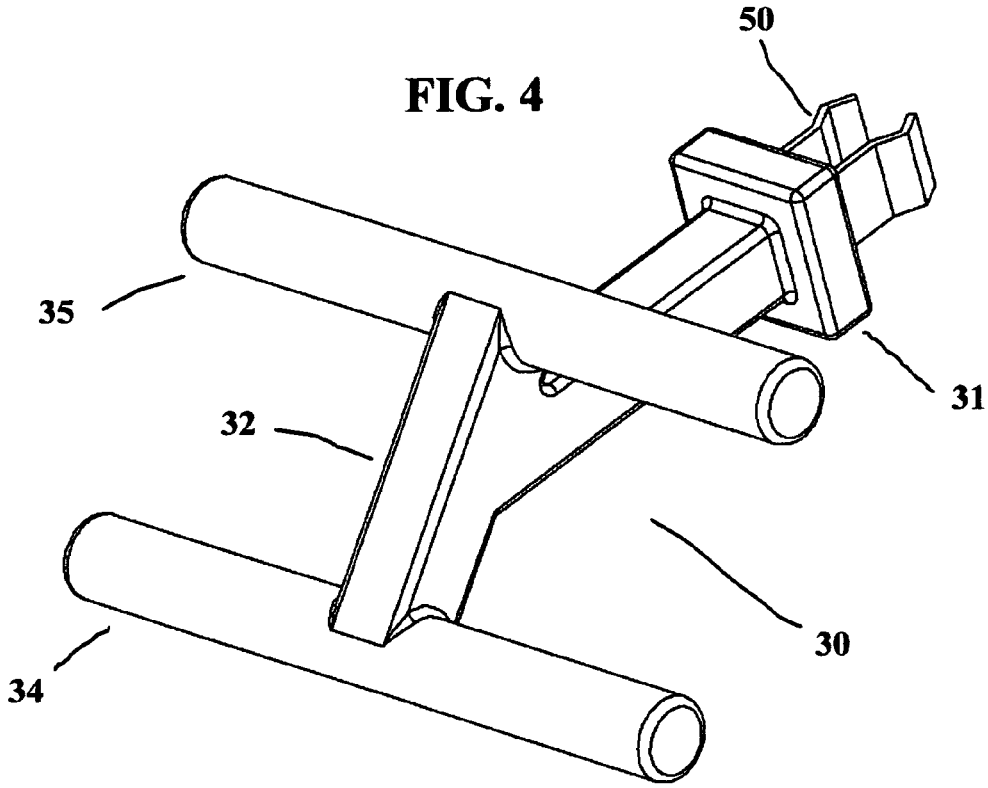
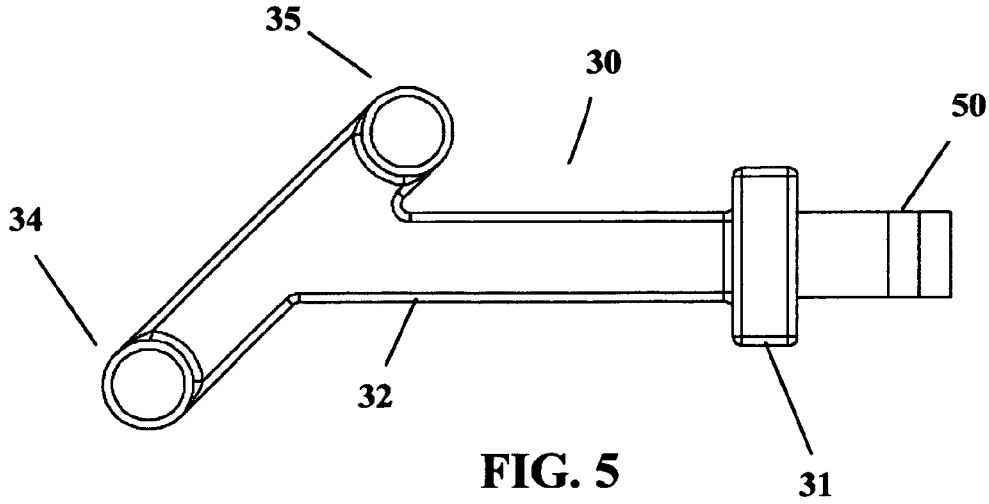
FIG. 5

Section B-B

UNIVERSAL SHOE RACK

BACKGROUND OF THE INVENTION

Numerous types of shoe racks have been developed for storing shoes in a convenient manner; some of which hold the shoes in a vertical orientation, such as on hoops, pegs or in pouches, while others retain the shoes in a horizontal, side-by-side position, such as on shelving, bars, or a cubby system. These methods for storing shoes are often designed around the physical restraints imposed by the shoe geometry, including width, height, and length. The different variations of shoe racks described in the prior art provide for a dizzying array of styles of shoe racks, each having a different look, a different way of holding or hanging the shoe, and a different method of addressing the physical requirements of the shoes. Some shoe racks are mounted to a wall, some are hung over a door, and still others are provided to free stand, and all provide for a means to store shoes.

The primary problem with conventional shoe racks is their inability to have sufficient flexibility or interchangeability as the size and number of shoes required to be stored varies. This leads to excessive wasted space or worse yet, certain types of shoes that are not compatible with the shoe rack design. Some types of shoe racks include a surface or mounting on which the bottom of the shoes rest side-by-side in a down-ward, sloped position. Because the number of shoes placed side-by-side is limited by width of the shoes, any variation in shoe height provides for an overall underutilization of space due to the excess space that exists above and below individual pairs of shoes. For shoe racks that hold the shoes on an upside down "U" shaped holder or in pouches, such as are often mounted on the back of a door, the number of shoes which may be held is limited by the number of evenly spaced holders, and furthermore the ability to locate a pair of shoes is hindered by lack of visibility of the tops of the shoes. Other types of shoes racks include shelf, rack, pouch, and cubby systems, and each one has different limitations as to the size, shape, width, length or height of the shoes that it can accommodate. Other problems related to the prior art involve stability of the systems, and inability of the shoe racks to retain shoes in a secure fashion. For example, typical door-mounted styles of hanging shoe racks have a limitation such that when the door is opened, the shoe racks lack the lateral support necessary to keep the shoes from falling or sliding off.

Accordingly, the need exists for an inexpensive hanging or universal shoe rack having the versatility to be mounted in both a vertical and horizontal manner, and which can overcome many of the limitations of the previous art. Shoe racks in the prior art are unable to accommodate the wide variety of shoes including: dress, casual, sports (low-top and high-top), women's high-heel (including those with straps or laced and without a back support), work boots, galoshes, hiking boots, slip-ons, sandals, flip-flops, and specialty shoes. Shoe racks in the prior art are unable to accommodate differences in size and geometry inherent in men's, women's, and children's shoes. Whereas other shoe racks are designed to be mounted to a particular surface, a shoe rack design is required which can be mounted on, but is not limited to, the following locations: a door, a wall, a ceiling, a dresser, a work-bench, and a circular or carousel style of rack system or free-standing shoe display.

The present invention addresses these and other problems associated with the prior art.

SUMMARY OF THE INVENTION

A shoe rack for hanging, storing, or displaying shoes comprising: a central support structure; and a plurality of brackets that are mounted to the central support structure, said brackets each including a mounting hook and a heel support, said mounting hook which protrudes from the front surface of the central support structure and terminates with a hooked portion which is directed in a downward position and angled towards the heel support, said mounting hook positioned such that the inside back portion of a shoe comes into contact with the mounting hook and the back of the shoe comes into contact with the heel support that is located below the mounting hook, such that the shoe would be held in a substantially horizontal orientation, with the front of the shoe pointed in a direction opposite to that of the central support structure.

The foregoing and other objects, features and advantages of the invention will become more readily apparent from the following detailed description of a preferred embodiment of the invention which proceeds with reference to the accompanying drawings.

BRIEF DESCRIPTION OF THE DRAWINGS

FIG. 4 is a perspective view of a universal dual-shaft bracket;

FIG. 5 is a side view of the universal dual-shaft bracket;

DETAILED DESCRIPTION

Figure 1:
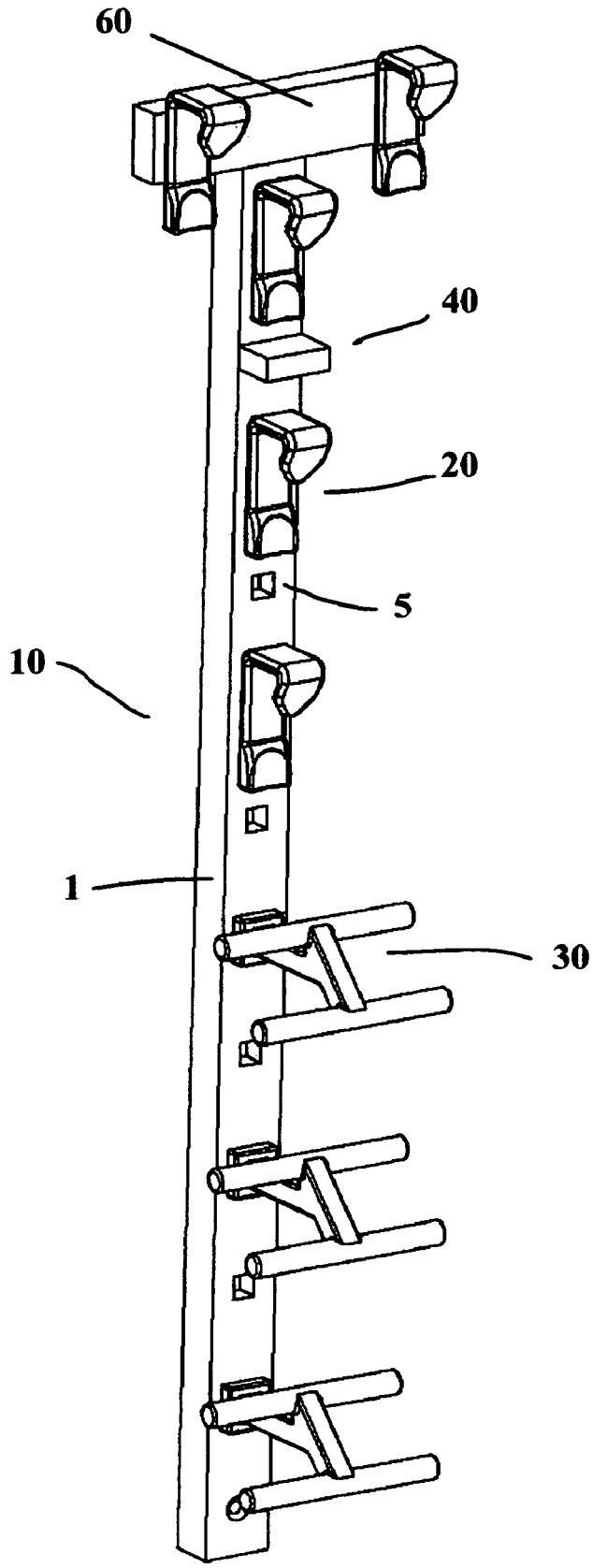
FIG. 1 is a perspective view of a universal shoe rack system.
Figure 10:
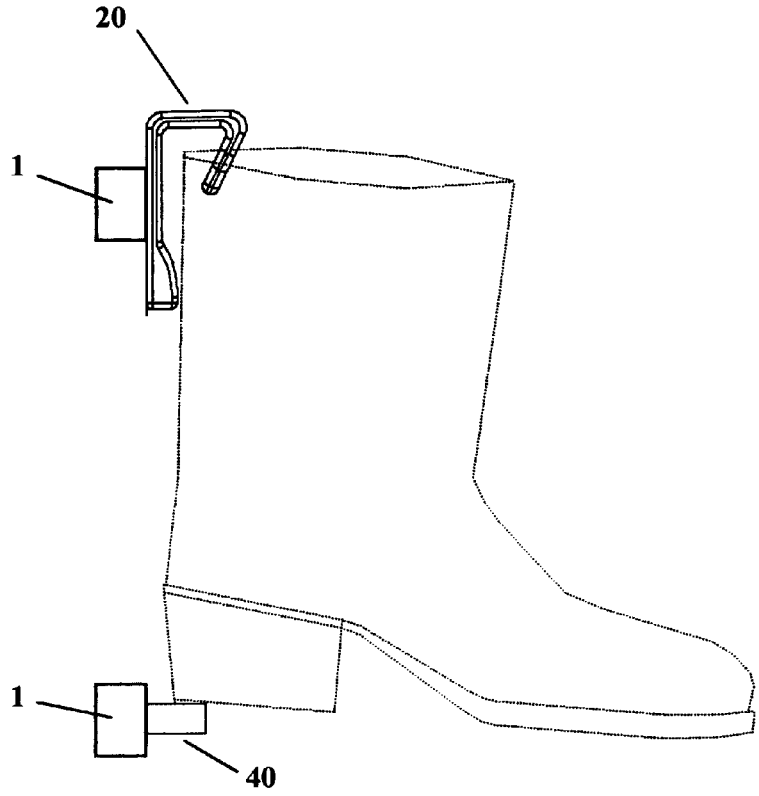
FIG. 10 is a side view of the universal heel bracket and universal heel block used in combination to hold a tall boot.
Figure 11:
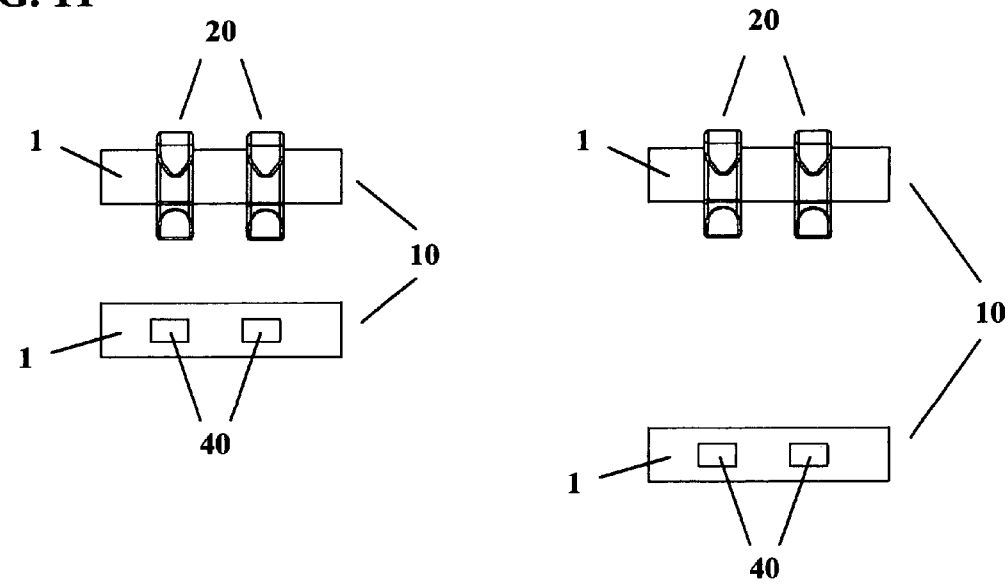
FIG. 11 is a front view of the universal shoe rack system in segments to accommodate pairs of taller work boots or galoshes of different heights.

FIG. 1 illustrates a modular, universal shoe rack system denoted generally by reference number 10, and which includes a central support structure 1, a universal heel bracket 20, a universal dual-shaft bracket 30, a universal heel block 40, and a double mounting arm bracket 60. The support structure 1, and the system 10, in general, may be mounted in either a vertical or horizontal orientation, or in a position intermediate between vertical and horizontal, to accept one or more shoe brackets. Screw holes 2 and 3 located at either end of the support structure 1 enable the system 10 to be mounted to a wall, door, desk, ceiling or a previously installed tubular style rack system or other support structure, while screw hole 1 located in the center of support structure 1 can be used for additional support in a horizontal orientation. The spacing of the screw holes 1, 2, & 3 coincides with the standard spacing of framing studs in most housing construction. In addition, a hanging bracket could be attached through the screw hole 2 located at the top of the support structure 1 such that the hanging bracket could be used to mount the system 10 to the top of a door as used in some conventional shoe rack systems. The brackets 20, 30 and 60, and the universal heel block 40, include a special mounting clip 50 (see FIGS. 2, 4 and 6) which allows the aforementioned parts to be easily attached and detached to the support structure 1 in seconds. The mounting clip 50 allows the system 10 to be universal in its application, whereby each of the brackets and other attachments may be mounted in multiple, interchangeable locations and orientations when rotated by 90 degrees on the support structure 1. A different type of mounting clip 50 or mounting mechanism may be envisioned which would include a rounded mounting clip, for example, that would provide for an incremental or infinite rotated positions when the central support structure 1 is oriented in a position between vertical and horizontal. In this way the shoes would continue to be held in an upright position regardless of the orientation of the central support structure 1. The support structure 1 may be either a solid or tubular shaped design, and can also be segmented to accommodate different applications, such as the combination of the universal heel bracket 20 and universal heel block 40 (see FIGS. 10 & 11), for example.

Figure 2:
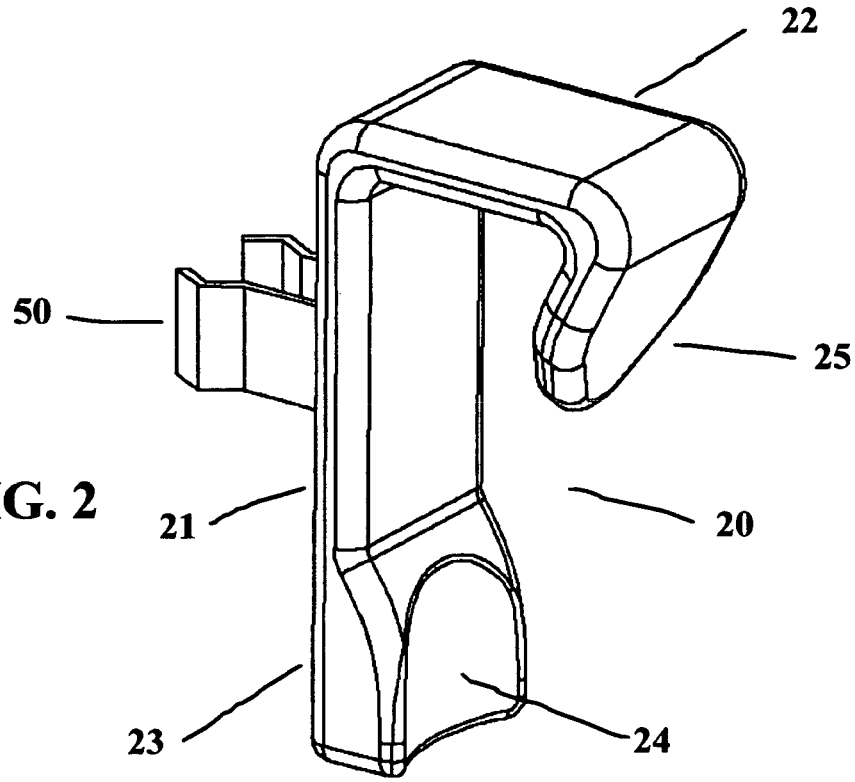
FIG. 2 is a perspective view of a universal heel bracket.
Figure 3:
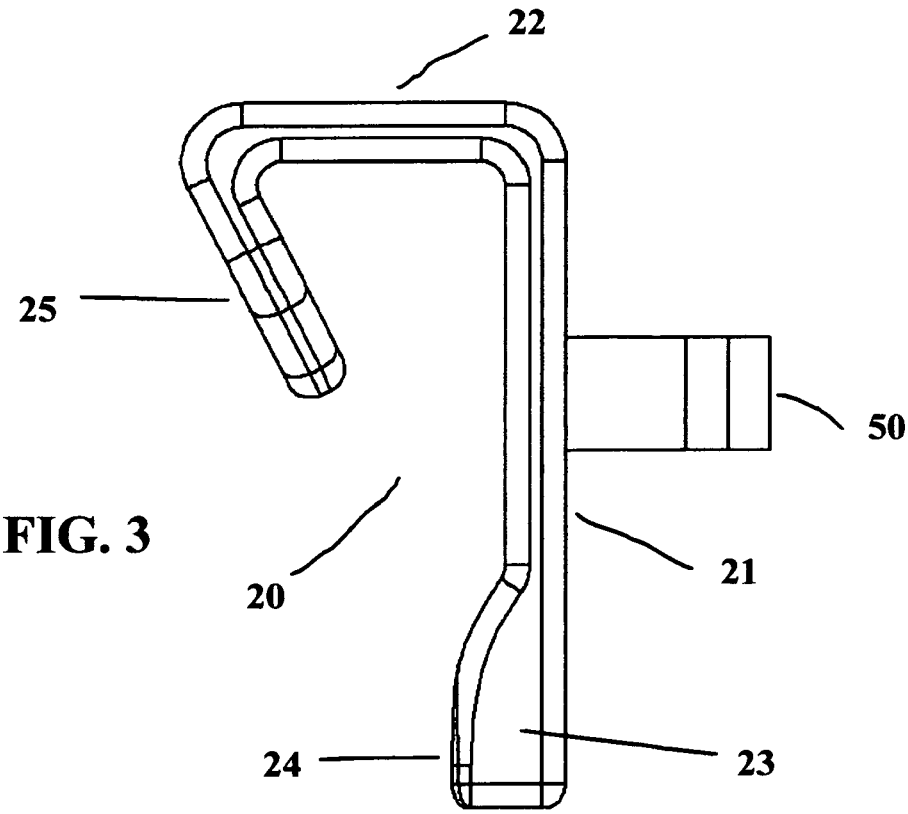
FIG. 3 is a side view of the universal heel bracket.
Figure 7:
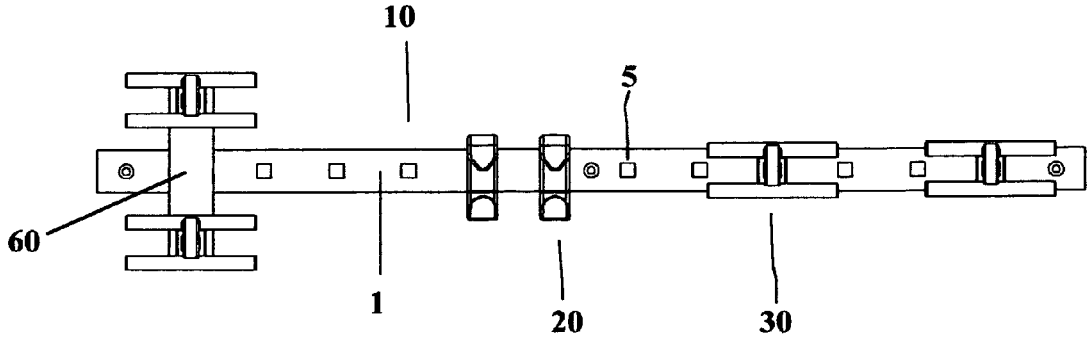
FIG. 7 is a perspective view of the universal shoe rack system mounted in a horizontal orientation.

The universal heel bracket 20 shown in perspective view as FIG. 2 and in side view as FIG. 3; is well suited for a wide variety of different shoe types, including dress, casual, and sport shoes. The heel bracket 20 is able to accommodate men's, women's (including some types of high-heel, or "pump"), and children's shoes. Shoes can be mounted to the heel bracket 20 with the support structure 1 in either a vertical or horizontal orientation, as shown in FIG. 1 and FIG. 7, respectively. The heel bracket 20 includes a mounting clip 50 which may be used to attach the heel bracket 20 to a bracket mounting hole 5 on the support structure 1. The mounting clip 50 is rigidly attached to a vertical support arm 21 which provides the structural support for the remaining components of the heel bracket 20. At the base of the support arm 21 is a heel support 23, which provides a further extension to the support arm 21, and a surface against which the heel of a shoe may rest when the shoe is being hung, stored, or displayed. At the top of the support arm 21 is a mounting arm 22 which is positioned at approximately 90 degrees from the support arm 21 and is located on the opposite side of the support arm 21 as the mounting clip 50. The mounting arm 22 projects away from the support arm 21 a sufficient distance for the back of a shoe to be located underneath. At the end of the mounting arm 22 opposite from the support arm 21 is a mounting hook 25 which is curved down in the general direction of the heel support 23.

The hanging of a shoe when using the heel bracket 20 is now described. The shoe is held in an upright position; with the rear of the shoe at a slightly or significantly lower position than the toe of the shoe, with the back side of the heel of the shoe pointed towards the support structure 1. The shoe is pressed against the heel bracket 20 and raised such that the top back of the shoe comes into contact with the mounting arm 22, and the outside back portion of the heel or shoe comes into contact with the heel support 23. The front of the shoe is then allowed to rotate down, while keeping the heel of the shoe in contact with the heel support 23, until the inside back portion of the shoe comes into contact with the mounting hook 25. When the shoe is released, the shoe is supported by a cantilevered force between the heel support 23 and the mounting hook 25. Similarly, a shoe that does not have a back surface, but rather has a back strap such as a woman's high heel shoe, may be hung from the heel bracket 20, wherein the back strap rests against the mounting hook 25, and the heel bracket 20 otherwise performs as described previously.

Figure 9A:
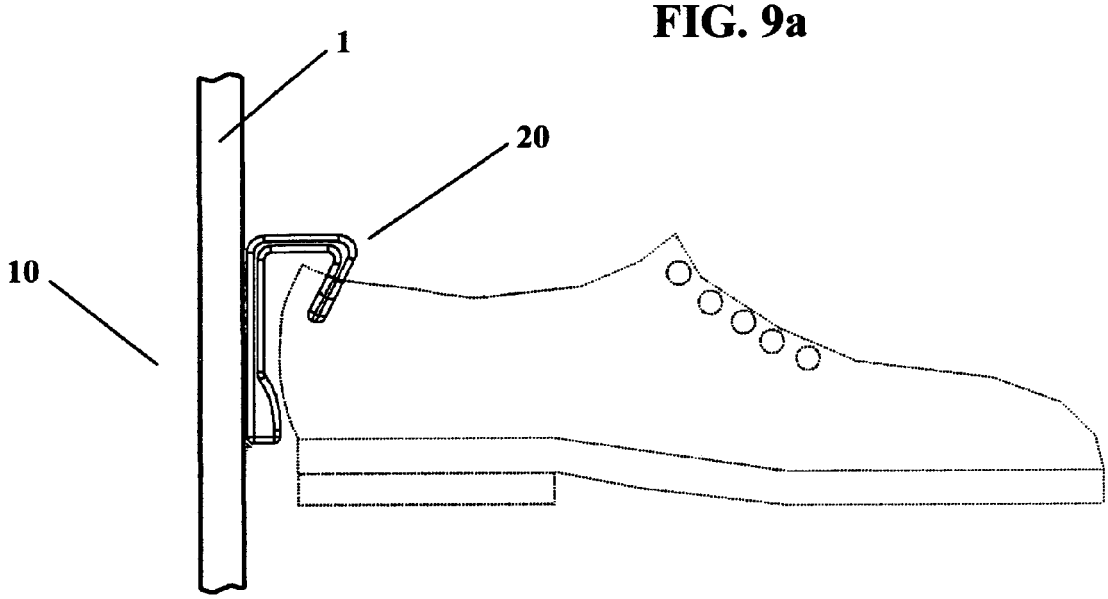
FIG. 9*a* is a side view of the universal heel bracket with a men's dress shoe.

In one embodiment, the angle of curvature of the mounting hook 25 is greater than 90 degrees in order to increase the surface for the inside back portion of the shoe to rest against when the shoe is mounted on the heel bracket 20. Because most shoes are designed to get narrower and are inclined from the heel to the ankle portion of the shoe, a slightly angled mounting hook 25 will provide more points of contact, and therefore more resistance to the shoe falling or sliding off the system 10. In one embodiment, the heel support 23 includes a concave surface 24 by which the heel or back of the shoe may rest against and therefore provide continuous points of contact between the heel support 23 and the back of the shoe. In this manner, the shoe is supported in a lateral, or rotational, direction, in addition to the heel support 23 providing a surface against which the back of the shoe rests. The heel support 23 accepts the rear portion of most shoes and allows them to hang in a secured, substantially level fashion. The angle of the mounting hook 25 and the length of the mounting arm 22 can all be designed such that the shoe will hang in a more vertical orientation, with the front of the shoe at a slightly or significantly lower position than the heel of the shoe, rather than the substantially horizontal orientation shown in a preferred embodiment in FIG. 9*a*. The heel support 23, the support arm 21 and the mounting arm 22 may be three separate pieces rigidly attached to each other, or a single piece.

A simplified version of the universal heel bracket 20 is also envisioned, whereby the heel support 23 would not be required in the system, and the heel of the shoe would instead rest directly against the support structure 1. The functionality of this embodiment would otherwise be as described above. Similarly, the support arm 21, the mounting arm 22, and the mounting hook 25 can all be created from a single curved hook that is mounted directly to the support structure.

The universal dual-shaft bracket 30 is used for shoes that do not include a back surface or back strap, such as some types of women's high heel shoes, slip-on shoes, sandals and flip-flops. The dual shaft bracket 30 is shown in perspective view as FIG. 4 and in side view as FIG. 5. The dual-shaft bracket 30 includes a mounting clip 50 which may be used to attach the dual-shaft bracket 30 to a bracket mounting hole 5 on the support structure 1. The mounting clip 50 is rigidly attached to a vertical support base 31 which provides the structural support for the remaining components of the dual-shaft bracket 30. A mounting plate 32 is rigidly attached to the support base 31. The mounting plate 32 may be of varying designs, including a single square or rectangular sheet, but is shown in the preferred embodiment as including minimal material to support a lower shaft 34 and an upper shaft 35, at a fixed distance from the mounting plate 32. The lower shaft 34 is positioned such that the distance between its centerline and the mounting plate 32 is less than half the length of standard shoe. The top shaft 35 is positioned a distance from the mounting plate 32 which is less than the distance from the lower shaft 34 to the mounting plate 32. The lower shaft 34 and top shaft 35 are parallel with each other, and their lengths are approximately equal to that of the width of two standard shoes.

Figure 9B:
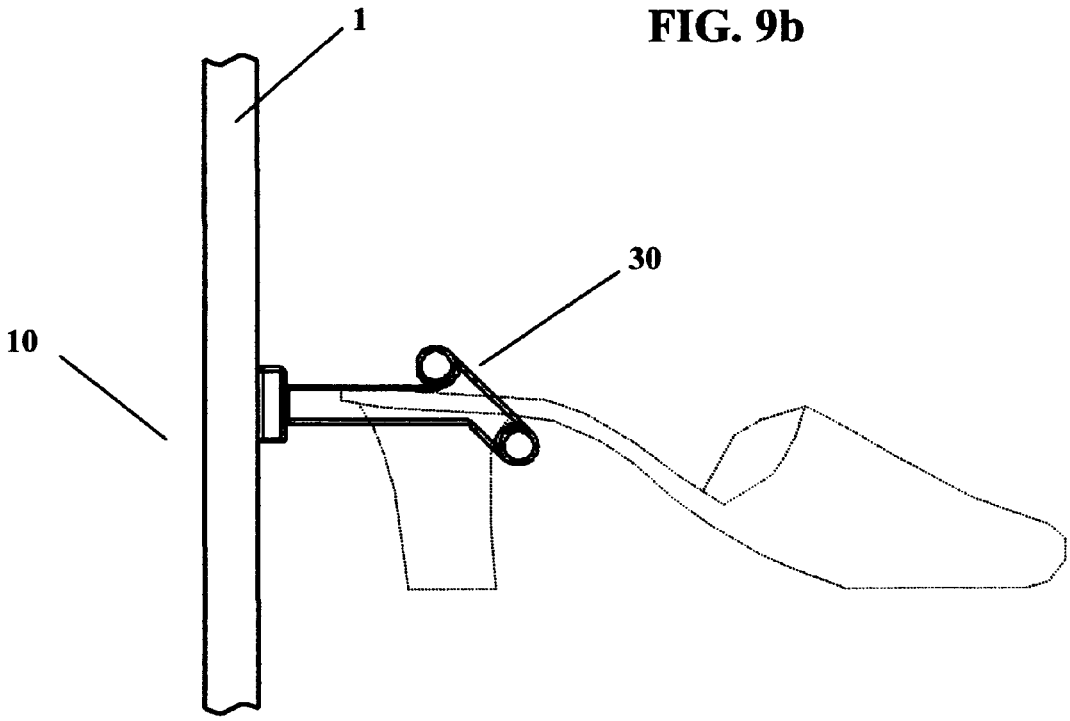
FIG. 9*b* is a side view of the universal dual-shaft bracket with a women's dress shoe.

The hanging of a pair of shoes when using the dual-shaft bracket 30 is now described. A first shoe is held in an upright position, with the rear of the shoe at a slightly or significantly lower position than the toe of the shoe, and the back edge of the shoe pointed towards the support structure 1. The first shoe is slid sideways between the lower shaft 34 and the upper shaft 35, on either side of the mounting plate 32, such that the top of the first shoe is facing the upper shaft 35, while the bottom of the first shoe is resting against the lower shaft 34. The front of the first shoe is then allowed to rotate down, while keeping the bottom of the first shoe in contact with the lower shaft 34, until the top of the first shoe comes into contact with the upper shaft 35. When the first shoe is released, the first shoe is supported by a cantilevered force between the lower shaft 34 and the upper shaft 35, due to gravity, and as shown on FIG. 9*b*. A second shoe is similarly hung on the shoe rack, however on the opposite side of the mounting plate 32 as the first shoe. In case of a small shoe, the shoe might have to be shifted either backwards or forward to find its mid-point or approximate center of gravity relative to the lower shaft 34, a sufficient distance away from the support base for the cantilevered force to be created. Therefore, in order for gravity to hold the small shoe in place by means of the cantilevered force, the shoe is initially placed a sufficient distance from the support base such that the shoe will remain in position between the lower shaft 34 and the upper shaft 35 when the shoe is released.

Figure 6:
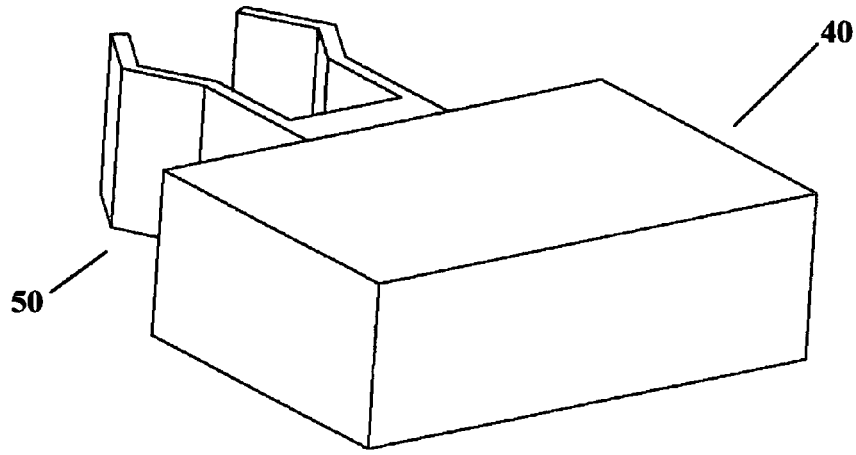
FIG. 6 is a perspective view of a universal heel block.

FIG. 6 depicts a heel block 40 which, in conjunction with the heel bracket 20, is used to hang, mount or display work boots, galoshes, and other tall types of shoes and boots. The top portion of the shoe would be held in place by the heel bracket 20, as described previously, whereas the bottom of the heel rests on the heel block 40 to provide vertical support. Because of the height and geometry of some types of shoes, the cantilevered force obtained when using the heel bracket 20 may not be sufficient to hold the shoe, and the shoe could fall or slip off the system 10. The additional vertical support provided by the heel block 40 will keep the shoe from falling. More elaborate versions of the heel block 40 can easily be envisioned such that the heel of the shoe would be kept from sliding away from the support structure 1 by means of a ridge or boss mounted on the heel block 40 and that would come into contact with the inside edge of the underside of the heel, for example. Another embodiment might include two support structures 1, in a horizontal orientation; with the upper support structure 1 using the heel bracket 20 and lower support structure 1 using the heel block 40 (see FIG. 10). The vertical separation of the support structures would relate to the height of work boots, galoshes, and other tall types of shoes and boots being mounted, hung or displayed (see FIG. 11). Support structure 1 could also be segmented to accommodate pairs of taller shoes in the above description of two support structures 1, in a horizontal orientation, at differing mounting heights.

In one embodiment, the heel block 40 is replaced with the top surface of a mounting arm 22 used in a heel bracket 20 positioned below the tall shoe or boot. This optimizes space usage of the system 10 and also serves to hold the shoes with the least number of components. Because the mounting clips 50 may be repositioned in any bracket mounting hole 5, the distance between two heel brackets 20 can be adjusted to fit the height of any shoe.

A double mounting arm bracket 60, an example of which is shown in FIG. 1 & FIG. 7, is used to double the amount of shoes that can be mounted on the system 10, using either the heel bracket 20 or the dual-shaft bracket 30, or a combination of both without the need to increase most of the components. For example, a system 10 that is able to accommodate six individual shoes when six heel brackets 20 are attached to the support structure 1, would now be able to accommodate six pairs, or twelve shoes, when six double mounting arm brackets 60 are attached to the same support structure 1. The double mounting arm bracket 60 is designed such that each pair of shoes may be mounted side-by-side, or one on top of the other. An example of the system 10 with a double mounting arm bracket 60 and two heel brackets 20 that allows shoes to be mounted side-by-side, with the support structure 1 in a vertical orientation is shown in FIG. 1.

Similarly, a system 10 that is able to accommodate six pairs of shoes when six dual-shaft brackets 30 are attached to the support structure 1, would now be able to accommodate twelve pairs, or twenty four shoes, when six double mounting arm brackets 60 are attached to the same support structure 1. A doubling of the number of shoes that can be mounted is achieved without increasing the number of support structures 1. The double mounting arm bracket 60 is designed such that both pairs of shoes may be mounted side-by-side, or one on top of the other. An example of the system 10 with a double mounting arm bracket 60 and two dual-shaft brackets 30 that allows two pairs of shoes to be mounted one pair on top of the other is shown in FIG. 7.

Figure 8A:
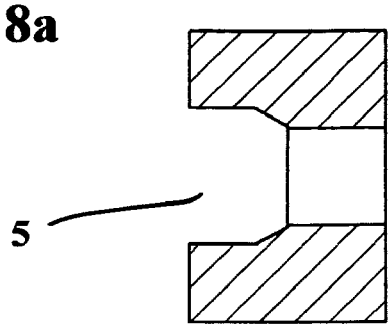
FIG. 8*a* is a cross-sectional view of a bracket mounting hole as indicated in FIG. 8*b;*
Figure 8B:
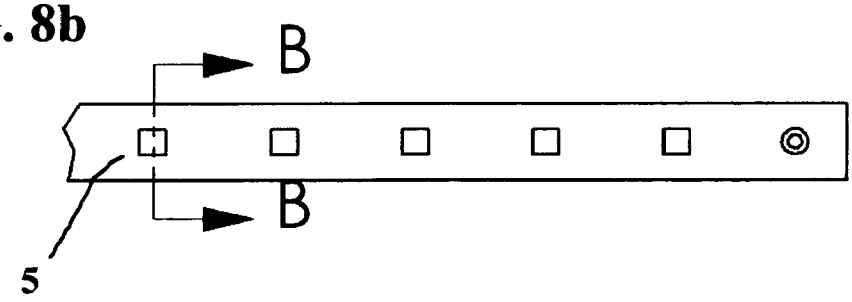
FIG. 8*b* is a partial view of a central support structure.

FIG. 8*a* is a cross-sectional view of the bracket mounting hole 5 that is indicated in the partial view of the central support structure 1 shown in FIG. 8*b*. The mounting clip 50 in one embodiment includes curved, flexible springs or clips that can be hand pushed into the bracket mounting hole 5 by using minimal force. The clips flex inward at the relatively narrow opening of the bracket mounting hole 5, and then are allowed to expand to their normal shape when the clips pass into the wider back portion of the bracket mounting hole 5. Because there is minimal axial force that is applied to the mounting clip 50, that is, along the centerline of the bracket mounting hole 5, the clips may be kept relatively flexible and the mounting clip 50 will not fall out of the bracket mounting hole 5 unless intentionally removed by pulling it out. Because the clips are flexible, the mounting clips 50 are easily inserted, removed, and reinserted in any of the bracket mounting holes 5 in a modular fashion. An alternative embodiment might have the mounting clip 50 attached directly to, or embedded in, the support structure 1 such that the different mounting brackets 20, 30, 40 & 60 with the bracket mounting hole 5 incorporated can thereby be attached to the support structure 1 by connecting the bracket mounting hole 5 to the mounting clip 50. Different types of mounting clips 50 or other mounting mechanisms are contemplated in this invention which provide for brackets 20, 30, 40 and 60 to be mounted to the central support structure 1.

As described, the universal shoe rack system 10 may be used in residential and commercial applications. Residential applications include using the system 10 in homes, condominiums, apartments, recreational vehicles, boats, or any other location where space is a limited commodity and utility is paramount. Commercial applications include trade shows, displays in shoe stores, golf and other sports stores, or any other location where shelf space utilization needs to be optimized. The universal shoe rack allows flexibility, adaptability, and creativity when it comes to mounting shoes for viewing, storing, and selling. For example, the system 10 could be incorporated into a dedicated shoe closet, complete with swinging doors, or in some other type of shoe display, closet system, or home furnishing. Because the system 10 may be attached to virtually any wall or similar support structure, the shoes can be mounted at the ideal height for individuals who have bad backs, or for small children, for example. Similarly, the system 10 is ideal for storing shoes in the garage, residential work, (mud) room, or in a commercial environment.

The universal shoe rack system 10 provides the additional benefit of making the shoes highly visible when mounted, and this allows a family member or customer to easily see and locate the exact shoes they are looking for without having to take the shoes off of the system 10, to see the top for example. The approximately horizontal position and forward orientation of the shoes also allows for easy dusting without removing the shoes from the system 10. The system 10 does not have many of the same limitations of existing shoe racks; shoes of varying height, width and length may all be mounted on the same system 10 in a variety of combinations and orientations.

In the preferred embodiment, the universal shoe rack system 10 is comprised of components which are of substantially solid materials, such as plastic, wood or metal, however the components could also be designed with tubular, or hollow, materials which provide the same functionality as described in this invention. Furthermore, the components could be a comprised of a bare wire frame, or a wire frame encased in vinyl or some other protective coating, or a combination of some or all of the above.

For the sake of convenience, the invention is described as various interconnected functional components. This is not necessary, however, and there may be cases where these components are equivalently aggregated into one or more embodiments.

Having described and illustrated the principles of the invention in a preferred embodiment thereof, it should be apparent that the invention may be modified in arrangement and detail without departing from such principles. I claim all modifications and variation coming within the spirit and scope of the following claims.

I claim:

1. A shoe rack system for hanging, storing, or displaying shoes comprising:

a central support structure;

one or more brackets that are mounted to the central support structure, said brackets each including a mounting hook configured to come in contact with an inside back portion of a shoe, such that the shoe is held in a substantially horizontal orientation; and a heel support mounted to the central support structure and including a concave surface facing away from the central support structure and configured to provide multiple points of contact with an outside back portion of the heel of the shoe and thereby provide lateral support for the shoe.

2. The shoe rack system according to claim 1 wherein the heel support and the mounting hook are included in each bracket as an integral unit and are mounted to the central support system by a single mounting mechanism.

3. The shoe rack system according to claim 2 wherein the single mounting mechanism is configured to be inserted and reinserted into any one of a plurality of bracket mounting holes that are provided in the central support system.

4. The shoe rack system according to claim 1 including a double mounting arm bracket that shares a single mounting mechanism and which includes two mounting hooks.

5. The shoe rack system according to claim 4 including two heel supports.

6. The shoe rack system according to claim 3 wherein the central support structure is configured to be positioned in either of a vertical and horizontal orientation, in relation to the longest dimension of the central support structure, and wherein the brackets are configured to be mounted in two or more positions by rotating the single mounting mechanism in relation to the central support structure, thereby allowing the shoe to be held in a substantially horizontal orientation regardless if the central support structure is positioned in either of the vertical and horizontal orientations.

7. The shoe rack system according to claim 6 wherein the brackets include a double mounting arm bracket that shares the single mounting mechanism and which includes two mounting hooks and two heel supports, wherein a pair of shoes may be held side by side.

8. The shoe rack system according to claim 1 including a heel block to support the bottom of the shoe.

* * * * *